US005326737A

United States Patent [19]

Kay et al.

[11] Patent Number: 5,326,737

[45] Date of Patent: Jul. 5, 1994

[54] CERIUM OXIDE SOLUTIONS FOR THE DESULFURIZATION OF GASES

[75] Inventors: D. Alan R. Kay, Burlington, Canada; William G. Wilson, Pittsburgh, Pa.

[73] Assignee: Gas Desulfurization Corporation, Pittsburgh, Pa.

[21] Appl. No.: 843,312

[22] Filed: Feb. 28, 1992

Related U.S. Application Data

[60] Continuation-in-part of Ser. No. 290,392, Dec. 29, 1988, abandoned, which is a continuation-in-part of Ser. No. 100,291, Sep. 23, 1987, Pat. No. 4,885,145, which is a continuation-in-part of Ser. No. 846,272, Mar. 31, 1986, Pat. No. 4,714,598, which is a division of Ser. No. 718,989, Apr. 2, 1985, Pat. No. 4,604,268, which is a continuation-in-part of Ser. No. 521,751, Aug. 8, 1983, Pat. No. 4,507,149, which is a continuation-in-part of Ser. No. 471,773, Mar. 3, 1983, abandoned, which is a continuation of Ser. No. 174,024, Jul. 31, 1980, Pat. No. 4,397,683.

[51] Int. Cl.[5] ..... B01J 20/06; B01J 20/04; B01J 23/10; C01F 17/00

[52] U.S. Cl. ..... 502/400; 423/230; 423/263; 502/302; 502/303; 502/304

[58] Field of Search ..... 502/400, 304, 303, 302, 502/525; 423/21.1, 263

[56] References Cited

U.S. PATENT DOCUMENTS

| | | | |
|---|---|---|---|
| 1,912,455 | 6/1933 | Ingraham | 423/542 |
| 3,211,549 | 11/1965 | Kusaka | 75/134 |
| 3,277,184 | 10/1966 | Ryland et al. | 502/304 |
| 3,425,793 | 2/1969 | Bauer et al. | 23/20 |
| 3,784,374 | 1/1974 | Almand | 75/129 |
| 3,795,505 | 3/1974 | Corradini | 75/53 |
| 3,816,103 | 6/1974 | Link, Jr. et al. | 75/53 |
| 3,818,869 | 6/1974 | Blaskowski | 122/5 |
| 3,892,836 | 7/1975 | Compton et al. | 502/304 |
| 3,901,947 | 8/1975 | Enomoto et al. | 502/304 |
| 3,903,020 | 9/1975 | Sergeys et al. | 502/304 |
| 3,909,212 | 9/1975 | Schroeder | 44/1 R |
| 3,974,256 | 8/1976 | Wheelock | 423/230 |
| 3,980,763 | 9/1976 | Mullhaupt | 502/304 |
| 4,002,720 | 1/1977 | Wheelock et al. | 423/230 |
| 4,018,597 | 4/1977 | Staggers | 75/58 |
| 4,140,655 | 2/1979 | Chabot et al. | 502/303 |
| 4,286,973 | 9/1981 | Hamlin et al. | 55/92 |
| 4,290,805 | 9/1981 | Gorgerino et al. | 75/120 R |
| 4,311,683 | 1/1982 | Hass et al. | 423/230 |
| 4,313,758 | 2/1982 | Henning et al. | 75/130 R |
| 4,346,063 | 8/1982 | Cahn et al. | 423/230 |
| 4,397,683 | 8/1983 | Kay et al. | 75/508 |
| 4,399,112 | 8/1983 | Voirin | 423/230 |
| 4,507,149 | 3/1985 | Kay et al. | 75/508 |
| 4,560,823 | 12/1985 | Gaffney | 585/656 |
| 4,604,268 | 8/1986 | Kay et al. | 423/230 |
| 4,642,177 | 2/1987 | Mester et al. | 423/21.1 |
| 4,657,886 | 4/1987 | Kolts | 502/303 |
| 4,714,598 | 12/1987 | Kay et al. | 423/230 |
| 4,789,454 | 12/1988 | Badwal et al. | 204/424 |
| 4,849,398 | 7/1989 | Takada et al. | 502/303 |
| 4,885,145 | 12/1989 | Kay et al. | 423/230 |
| 4,996,180 | 2/1991 | Diwell et al. | 502/304 |

OTHER PUBLICATIONS

*Treatise on Inorganic Chemistry* -H. Remy-vol. II-pp. 497-498 Elsevier Publ. Co. -New York 1956.

Bevan, D. J. M. and J. Kordis, "Mixed Oxides Of The Type $MO_2$ (Fluorite)-$M_2O_3$-I Oxygen Dissociation Pressures And Phase Relationships In The System $CeO_2$-$Ce_2O_3$ At High Temperatures", *J. Inorg. Nucl. Chem.*, vol. 26, pp. 1509-1523 (1964).

*Primary Examiner*—Paul E. Konopka

*Attorney, Agent, or Firm*—Buchanan Ingersoll

[57] ABSTRACT

A solid solution for the desulfurization of sulfur containing gases is provided in which the solution contains oxides having oxygen ion vacancies provided therein. The solid solution has a solvent which has at least one lanthanide oxide which crystallizes in the fluorite habit. The solid solution has a solute which contains a second oxide having a valence which differs from the valence of the lanthanide oxide present in the solvent.

9 Claims, 8 Drawing Sheets

Breakthrough Curve of $CeO_2.SrO/Al_2O_3$

Rate of $SO_2$ Uptake by $CeO_2$ Doped and Undoped Sorbents
Expressed in mg of $SO_2$ Absorbed vs Time at 550°C
Sample Weight 50 mg Breakthrough Curve of $CeO_2/Al_2O_3$ Breakthrough Curve of $CeO_2.SrO/Al_2O_3$

CERIUM OXIDE SOLUTIONS FOR THE DESULFURIZATION OF GASES

FIELD OF THE INVENTION

This application is a continuation-in-part of our application, Ser. No. 290,392, filed Dec. 29, 1988 now abandoned; which was a continuation-in-part of Ser. No. 100,291, filed Sept. 23, 1987, now U.S. Pat. No. 4,885,145; which was a continuation-in-part of our application Ser. No. 846,272, filed Mar. 31, 1986, now U.S. Pat. No. 4,714,598; which was a division of our application Ser. No. 718,989 filed Apr. 2, 1985 now U.S. Pat. No. 4,604,268; which was a continuation in part of our application Ser. No. 521,751 filed Aug. 8, 1983, now U.S. Pat. No. 4,507,149; which was a continuation-in-part of our application Ser. No. 471,773 filed Mar. 3, 1983, abandoned; which was a continuation of our application Ser. No. 174,024 filed Jul. 31, 1980 now U.S. Pat. No. 4,397,683.

This invention relates to the use of solid solutions of lanthanide oxides which crystallize in the fluorite habit such as cerium oxide ($CeO_2$) as a solvent, and an altervalent solute of (a) one or more of the other lanthanide oxides which do not crystallize in the fluorite habit or (b) one or more of the oxides of the alkaline earth elements or (c) combinations of the same. When the solvent and the altervalent solute are combined to form a solid solution which contains large numbers of oxygen ion vacancies, the ability of the solid solution to desulfurize gases is greater than the ability of lanthanides that crystallize in the fluorite habit to desulfurize gases without the addition of a solute. The addition of these altervalent solutes to the solvents which form solid solutions containing ionic porosity enhances the ability of these solid solutions to desulfurize gases in three ways by increasing: (1) the amount of sulfur that can be removed, (2) the utilization of the solid solutions, (3) the rate at which oxygen and sulfur can move in and out of the solid solution.

(Utilization = fraction of the stoichiometric amount of cerium oxide that could have reacted with the sulfur dioxide in the flue gases if the reaction had gone to completion).

The term "lanthanides" as used herein, includes the lanthanide "rare earth" elements having atomic numbers from 57 to 71, inclusive, and the element yttrium, atomic number 39, which is often found in lanthanide concentrates and acts similarly to the other lanthanides in many respects.

Those lanthanide oxides which crystallize in the fluorite habit are the oxides of cerium, praseodymium and terbium.

This invention further relates to the use of those solid solutions described above to desulfurize gases resulting from the complete combustion of hydrocarbons containing sulfur such as coal and fuel oil which are commonly called flue gases in which the sulfur is mainly in the form of sulfur dioxide ($SO_2$).

This invention further relates to the use of these solid solutions to desulfurize reducing gases such as fuel gases and other reducing gases formed during the conversion of crude oil and other industrial processes which produces gases with high CO, $H_2$ and hydrocarbon contents in which the sulfur is mainly in the form of hydrogen sulfide ( $H_2S$ ).

BACKGROUND OF THE INVENTION

According to the ENERGY HANDBOOK published by Van Nordstrom and Reinhold, there are 36.5 Quads ( one Quad = $10^{18}$ Btu) of energy in the coal reserves of the United States as compared to 1.4 Quads in oil and 111 Quads in natural gas. The United States Department of Energy (DOE) has taken the lead in the development of methods to utilize this energy in coal in an ecologically and economically acceptable manner. The DOE has taken the initiative in this matter because industry in the United States has been reluctant to pursue this task, and an agency of the U.S. Government has been forced to take the lead just as was the case in the development of synthetic rubber and nuclear power.

There is a further necessity to develop methods for the utilization of coal because of the political instability in the Persian Gulf which is a major source of much of the world's oil, and the wide fluctuations in the price of crude oil in the last few years are clearly indicative of this instability.

Evidence continues to mount with regard to the detrimental effects of acid rain. Most of the effort to reduce the emission of sulfur from presently operating power plants using steam turbines for the generation of electricity have been concentrated on the removal of sulfur dioxide from the flue gases after the complete combustion of the coal which requires the installation of scrubbers between the boiler of such power plans and the smoke stack.

The government of Canada has obtained an agreement with the United States for reduction of sulfur oxides ($SO_x$) and nitrogen oxides ($NO_x$) in flue gases from coal burning power plants in the United States. These power plants consume most of the coal mined in the U.S. There is a further agreement that the reduction in $SO_x$ and $NO_x$ will occur when effective and economical technology has been developed for their removal from flue gases. The U.S. Government and the power-generating industry in the U.S. are spending approximately one billion dollars in the next few years in search of this effective and economical technology for removal of $SO_x$ and $NO_x$, but to date, no completely satisfactory solution has been found. At present, most of this work is concentrated on achieving present Environment Protection Agency (EPA) regulations which require that the effluent from new power plants contain less than 1.2 lbs. $SO_2$/MMBtu of the fuel consumed. Some of the latest information on this subject was reported at the Fourth Annual Pittsburgh Coal Conference held in 1987.

Almost all of this money that will be spent over the next few years will be spent on pilot scale and demonstration units in an attempt to find a method of using calcium-based sorbents that will reduce $SO_2$ from flue gases to meet EPA requirements. The ability of these calcium-based sorbents will be investigated at both high (800° C.–1200° C.) and low (100° C.–150° C.) temperatures. The high temperature processes include the Limestone Injection Multiple Burner (LIMB) method, the pressurized fluid-bed combustion (PFBC) technique, and the atmospheric pressure fluid-bed combustion (AFBC) method. The low temperature process to be investigated is a variation of "flue gas scrubbers" or scrubbers which are currently in operation in 140 power plants in the U.S.

There are many shortcomings to these methods: (1) the expected desulfurization of all these processes is less than 50% of the input sulfur except for the fluid bed combustion processes where the sulfur reduction may be as high as 70%; (2) indications are that there will be less than 50% utilization of the calcium-oxide based sorbent; (3) the fundamentals of desulfurization of flue gases with calcium based sorbents are not well understood which may result in less than optimum desulfurization of the gases and utilization of the sorbent; (4) control of temperature in the low temperature desulfurization process must be held to plus or minus 20° F. which may be difficult when a boiler is operating in a load following mode; (5) with the low temperature processes the calcium based sorbents are introduced into the flue gases with water before the electrostatic precipitators (ESP) which reduces the temperature of the flue gases so that the stacks do not operate effectively; (6) there is no certainty that it will be possible to put the partially sulfated calcium sorbent into landfills because of: ( a ) potential environmental effects associated with handling fine caustic materials, (b) the heat generated by the reaction of unreacted lime with atmospheric moisture or water, (c) the corrosive nature of very basic solutions, (d) the increased quantities of solid waste. In addition, critical pieces of the equipment necessary to utilize calcium based sorbents are not presently available particularly with respect to the AFBC.

In addition to all of the operating and ecological problems mentioned above, it has been estimated that it costs approximately $900 to remove a ton of sulfur with scrubbers and $600 to $800 to remove a ton of sulfur with the LIMB process. The costs of $SO_x$ removal from flue gases by these methods will raise the cost of electricity by as much as one third as compared to the generation of electricity without sulfur removal.

The effluent from coal fired power plants is one of the major sources of $SO_2$, but there are other significant sources of $SO_2$ such as the effluent from roasters utilized to convert the ores of metals such as copper and nickel from some form of sulfides or sulfates to their oxides with the emission of large quantities of $SO_2$. The roasters of the International Nickel Co. in Sudbury, Ont. Canada are one of the major sources of $SO_2$ emissions in North America. The analysis of the gases resulting from the roasting of nickel or copper are not sufficiently different from the analysis of stack gases from boilers that desulfurization of roaster gas cannot be obtained with cerium oxide.

Technology for the desulfurization of fuel gases in which the sulfur is mainly in the form of hydrogen sulfide ($H_2S$) is presently oriented toward the use of in situ desulfurization with calcium-based sorbents in a fluid bed gasifier and a yet undeveloped sorbent for in situ desulfurization in entrained flow gasifiers. Desulfurization in situ with calcium-based sorbents in fluid bed gasifiers has achieved 90% reduction of $H_2S$ in the effluent gases.

The use of calcium-based sorbents for in situ desulfurization in fluid bed gasifiers suffers from most of the same problems associated with calcium-based sorbents for flue gas desulfurization except 90% sulfur removal has been achieved. There is no assurance the 90% sulfur removal can be consistently achieved which is necessary to meet present EPA requirement (less than 1.2 lbs. $SO_2$/MMBtu) in the gases finally exiting the process.

To insure compliance with present and future requirements for $SO_2$ emissions from processes using fuel gases and because of the uncertainty regarding disposal of partially spent calcium-based sorbents, additional effort is being expended to develop a regenerable sorbent for $H_2S$ capable of (1) reducing the $H_2S$ content of fuel gases to less than 100 part per million (ppm); (2) being regenerated back to its original form which is capable of again reacting with $H_2S$ with little or no loss of its ability to remove $H_2S$ from the fuel gases; (3) capable repeated cycles of sulfidation and regeneration.

Zinc ferrite is under exhaustive investigation to determine if it is capable of meeting these requirements. It is recognized that zinc ferrite has at least six possible deficiencies: (1) some solid phase boundaries which reduce stability and effectiveness; (2) sulfate formation during regeneration; (3) sorbent structural changes during sulfidation and regeneration cycles; (4) sorbent durability over many sulfidation and regeneration cycles; (5) regeneration of gas must be processed to remove sulfur; (6) the zinc component of the sorbent may vaporize at high operating temperatures. In addition, zinc ferrite cannot operate with fuel gases high in CO and $H_2$ because such gases reduce the zinc ferrite to a form of zinc oxide and iron oxide or their metals that are less capable of reacting with the sulfur.

Almost 300 million dollars has been accumulated by pooling funding from the DOE and industry to build a demonstration unit to confirm the applicability of in situ desulfurization of fuel gases with zinc ferrite polishing to produce fuel suitable for gas turbines for the next generation of electric power generating equipment.

Cerium oxide also has the ability to desulfurize fuel gases which are high in carbon monoxide and hydrogen where the sulfur is mainly in the form of $H_2S$, and flue gases which are high in carbon dioxide and oxygen where the sulfur is mainly in the form of $SO_2$. This unique ability to desulfurize gases of such wide variations in composition may be explained with the use of the Ce-S-O phase stability diagram, FIG. 1. The ordinate of this phase stability diagram is the logarithm of the partial pressure of oxygen (Log $pO_2$) and the abscissa is the log of the partial pressure of sulfur (Log $pS_2$). Fuel gases would be composed mainly of carbon monoxide, hydrogen, carbon dioxide, water and hydrogen sulfide. The oxygen content in such gases is very small and results from the dissociation of water and carbon dioxide at elevated temperatures. The partial pressure of sulfur in such gases results from the dissociation of the hydrogen sulfide. As a result, the ability of cerium oxide to desulfurize such gases is related to the sum of the partial pressure of oxygen from dissociation of the water and the carbon dioxide in the fuel gas.

Other gases such as those created by the distillation of crude oil necessary for the production of gasoline, motor oil etc. contain sulfur in the form of $H_2S$ or sulfur carbonyl (COS). These gases may contain in addition to CO and $H_2$ other hydrocarbons, but the partial pressure of oxygen in such gases is low, and they can be effectively desulfurized with cerium oxide as well as fuel gases derived from coal.

When considering flue gases, the partial pressure of the oxygen is mainly related to the amount of oxygen in the gases and the oxygen resulting from the dissociation of any carbon dioxide in the system is a minor component of the total. The partial pressure of sulfur in flue gases results from the dissociation of the sulfur dioxide. As a point of reference the partial pressure of oxygen in air is noted on the phase stability diagram ($pO_2=0.21$).

The limits of desulfurization with cerium are defined by the line labeled XYZ. Point B on that line is a value calculated from thermodynamic data representing a fuel gas containing 240 ppm $H_2S$ which serves as a point of reference for the extent of desulfurization with cerium oxide.

There are two forms of cerium oxide: ceric oxide ($CeO_2$) and cerous oxide ($Ce_2O_3$ or $CeO_{1.5}$) and there are a number of nonstoichiometric forms of cerium oxide whose composition may be expressed generically as $CeO_{(2-x)}$.

The extent of desulfurization of flue gases may be estimated from the phase stability diagram as being determined from the intersection of the line representing the partial pressure of oxygen in air and line XYZ. Since point B represent 240 ppm of $H_2S$ in a fuel gas, the intersection of the line representing the partial pressure of oxygen in air and line XYZ is several orders of magnitude lower in sulfur.

The Ce-O-S system encompasses the desulfurization of gases containing both $H_2S$ and $SO_2$. The thermodynamic principals and the benefits of using solid solutions of cerium oxide which crystallizes in the fluorite habit apply equally well to either type of gaseous desulfurization.

Bevan and Kordis (MIXED OXIDES OF THE TYPE $MO_2$(FLUORITE)-$M_2O_3$-I: OXYGEN DISSOCIATION PRESSURES AND PHASE RELATIONSHIPS IN THE SYSTEM $CeO_2$-$Ce_2O_3$ AT HIGH TEMPERATURES; Jr. Inorganic Nuclear Chem., 1964, Vol. 26, pp. 1509–1523, Permagon Press, Ireland.) have stated: "A characteristic property of $MX_2$ compounds crystallising with the fluorite structure [habit] is the readiness with which the cation lattice can incorporate quite a large proportion of altervalent ions to form 'anomalous mixed crystals' [solid solutions] for which the fluorite structure is apparently retained. Evidence that the cation lattice is virtually complete and the anion lattice highly defective [creation of oxygen ion vacancies] has been obtained from a comparison of X-ray and pycnometric densities, so that depending on the nature of the altervalent ion, the mixed crystal is thought to contain either vacancies or interstitial anions. Moreover, the distribution of altervalent cations on cation sites, and of the anion defects is generally assumed to be completely random."

The Bevan and Kordis article provides the scientific explanation for a "solid solution" as follows: "Evidence that the cation lattice is virtually complete . . . has been obtained from a comparison of x-ray and pyconometric densities . . . . Moreover, the distribution of altervalent cations on cation sites . . . is generally assumed to be completely random."

The Bevan and Kordis article does not address how the oxygen ion vacancies created could be utilized. Therefore, this article does not teach or suggest the ability of solid solutions of cerium oxide which crystallize in the fluorite habit containing oxygen ion vacancies to increase the extent of desulfurization, the utilization of the sorbent and the rate of desulfurization.

The use of cerium oxide for reaction with sulfur dioxide ($SO_2$) is described in Longo, U.S. Pat. No. 4,001,375 and Cahn, U.S. Pat. No. 4,346,063. Cahn teaches a technology whereby gases containing $SO_2$ and oxygen in amounts sufficient to prevent the formation of hydrogen sulfide ($H_2S$) are desulfurized with cerium oxide. Cahn further states that the temperature of desulfurization is from 350° C.–600° C., but Longo states that the rate of desulfurization of flue gases containing $SO_2$ with $CeO_2$ is low until the temperature of the reaction reaches 500° C. Because of the high rate of speed with which the products of combustion proceed through a boiler and because of the fluctuations in temperature when the boiler operates at various loads due to variations in demand for electricity it is required that a rapid rate of desulfurization be obtained at temperatures less than 500° C.

In addition to the necessity to increase the rate of reaction, it is also necessary to increase the utilization of the sorbent. Longo has achieved 50–70% utilization of an unsupported sorbent, but in order to reduce the cost of flue gas desulfurization with cerium oxide ($CeO_2$), utilization of the sorbent should be increased. Evidence will be supplied in the Examples to follow which shows that the rates of reaction of doped $CeO_2$ is greater than that of undoped $CeO_2$.

The use of $CeO_2$ for the desulfurization of fuel gases has been described by Wheelock et al., U.S. Pat. Nos. 4,002,720 and 3,974,256. However, neither Wheelock et al. reference teaches or suggests:

1. Difference between those lanthanides which crystallize in the fluorite habit and those that crystallize in other habits on their ability to desulfurize fuel and flue gases;
2. The importance of oxygen ion vacancies to enhance the ability of the lanthanides which crystallize in the fluorite habit to desulfurize both fuel and flue gases;
3. That the formation of solid solutions of those lanthanides which crystallize in the fluorite habit and the oxides of the alkaline earth elements or lanthanide oxides which do not crystallize in the fluorite habit can create additional oxygen ion vacancies in lanthanides which do crystallize in the fluorite habit; and
4. That the optimum amount of other oxides added to the lanthanide oxides which crystallize in the fluorite habit may be less than 15 mole %.

Various other patents which utilize lanthanides have been found which include:

1. Gaffney, U.S. Pat. No. 4,560,823;
2. Compton et al., U.S. Pat. No. 3,892,836;
3. Mulhlhaupt, U.S. Pat. No. 3,980,763;
4. Takada et al., U.S. Pat. No. 4,849,398;
5. Enomoto et al., U.S. Pat. No. 3,901,947;
6. Ryland et al., U.S. Pat. No. 3,277,184;
7. Bauer et al., U.S. Pat. No. 3,425,793;
8. Mester et al., U.S. Pat. No. 4,642,177; and
9. Sergeys et al., U.S. Pat. No. 3,903,020.

However, none of these patents teach or suggest:

1. That those lanthanides which crystallize in the fluorite habit are best suited for the desulfurization of gases;
2. That solid solutions of lanthanide oxides which crystallize in the fluorite habit and other altervalent oxides of alkaline earth elements or lanthanide oxides which do not crystallize in the fluorite habit or combinations of the other oxides have improved ability to desulfurize gases compared to lanthanides which crystallize in the fluorite habit without the addition of other oxides;
3. The function of oxygen ion vacancies created by reduction and the addition of altervalent oxides to the lanthanides which crystallize in the fluorite habit to enhance the removal sulfur from both fuel and flue gases; and
4. The limitations of the amount of the addition of altervalent oxides of the alkaline earth elements or the other oxides of the lanthanide group which are altervalent to $CeO_2$ and do not crystallize in the fluorite habit which together with the $CeO_2$ form the solid solutions of this invention.

Since the basis of this application is the creation and the utilization of "oxygen ion vacancies" in the fluorite type crystal lattice of the lanthanide oxides, it is necessary to describe one of the methods whereby the "oxygen ion vacancies" are formed. For this explanation cerium oxide, one of the lanthanide oxides which crystallizes in the fluorite habit, and magnesium oxide will be used, and the same combination of cerium and magnesium oxides may be used hereafter to typify this phenomenon. The use of oxides of cerium, and magnesium in any of the illustrations or examples in no way precludes the use of any of the oxides of the other members of the lanthanide group of elements that crystallize in the fluorite habit, other than cerium, nor does the use of the oxide of magnesium preclude the use of the oxides of any of the other members of the alkaline earth group of elements unless it is specifically noted as to the use of the specific members of the group of lanthanides or the group of alkaline earth elements.

The mechanism whereby the oxygen ion vacancies are formed in these solid solutions which crystallize in the fluorite habit may be explained as follows. In the discussion which follows, the cerium oxide of the solid solution which is formed will be the solvent, and the solute will be an oxide or combinations of one or more of oxides of the alkaline metals group or the oxides of other lanthanide which do not crystallize in the fluorite habit and whose valence is different (altervalent) than that of $CeO_2$. When one of the solute oxides of the alkaline earth elements such as MgO is in solution in the solvent cerium oxide crystal, the cation ($Mg^{+2}$) substitutes for one of the cerium cations ($Ce^{+3}$) or ($Ce^{+4}$). Since there can be no imbalance in electrical charges, the substitution of one $Mg^{+2}$ ion for one $Ce^{+4}$ or two $Ce^{+3}$ ions, creates one $O^{-2}$ vacancy in the lattice. This is exactly in accordance with the mechanisms described by Bevan and Kordis.

The general chemical formula for substances which crystallize in the fluorite habit is $MX_2$ where M represents one metal cation and $X_2$ represents two oxygen anions.

When altervalent solute oxides are added to solvent oxides such as $CeO_2$, the $CeO_2$ is said to be "doped." Hereinafter the term "doped $CeO_2$ will refer to solid solutions containing oxygen ion vacancies in which the $CeO_2$ is the solvent and the altervalent oxides added to form the solid solutions which crystallize in the fluorite habit is the solute which is called the "dopant."

Again using cerium oxide and magnesium oxide for illustration purposes, the cerium oxide without the magnesium oxide is like a checkerboard with a checker in each square, which immobilizes all the checkers except those at the edge. However an oxygen ion vacancy in the crystal lattice of the cerium oxide would be analogous to removing at least one checker from the checkerboard whereby all of the other checkers become more mobile. If the goal was to replace the checker in the exact center of the board, it would be much simpler if there were many vacancies on the board so that the new checker could be maneuvered into the center by moving the other checkers to make multiple paths to the center of the checkerboard.

All dopants that have the same valence that form solid solutions with lanthanide oxides that crystallize in the fluorite habit form equal numbers of oxygen ion vacancies, and they will be referred to hereinafter as "doped oxygen ion vacancies." The effectiveness of the dopant with regard to the conductivity in solid electrolytes is a maximum when the ionic radius of the dopant is equal to the ionic radius of the lanthanide being doped. If the ionic radium of the dopant is different than the ionic radius of the lanthanide oxide being doped, there will be distortion of the crystal lattice, (the binding energy between the dopant cations and the oxygen ion vacancies will increase) and the ionic conductivity of the lanthanide oxide will be reduced. It is expected that the resistance to the entry of sulfur into the doped lanthanide crystals and the escape of oxygen from the crystals will increase as distortion of the crystal lattice increases.

The reaction for the removal of sulfur as $H_2S$ from gases resulting from the partial combustion of coal (fuel gases) can be simply expressed as follows:

$$2CeO_2(s)+H_2S(g)+H_2(g)=Ce_2O_2S(s)+2H_2O(g) \quad (1)$$

In the reaction described in equation (1) there are two kinds of checkers (anions) that are moving in the crystal lattice. The anions of sulfur ($S^{-2}$) are moving into the lattice of the cerous oxide and anions of oxygen ($O^{-2}$) are moving out. The ultimate goal of all desulfurization processes is to use as much of the desulfurization agent as possible. That goal can best be achieved by increasing the ease of movement of the sulfur anions trying to get into the cerium oxide crystal lattice and by increasing the ease of movement of the oxygen anions out of the crystal lattice.

The most common form of cerium oxide is ceric oxide ($CeO_2$). The best form of cerium oxide for removal of $H_2S$ is cerous oxide ($Ce_2O_3$). There is, however, a series of non-stoichiometric forms of cerium oxide between ceric oxide and cerous oxide. These non-stoichiometric forms of cerium oxide can be prepared by exposing ceric oxide to reducing gases such as hydrogen. When ceric oxide is converted to these non-stoichiometric forms, whose formula can be written as $CeO_{2-x}$ there is a loss of weight due to removal of oxygen from the crystal lattice (formation of oxygen ion vacancies). Oxygen ion vacancies created by exposure of cerium oxide to reducing gases will hereinafter be referred to as "reduction oxygen ion vacancies". Cerium oxide is no longer in the fluorite crystal habit when reduction of cerium oxide to an oxidation state lower than $CeO_{1.714}$ is achieved, and this is likely to result in the elimination of the reduction oxygen ion vacancies. FIG. 2, from Bevan and Kordis, shows the extent of removal of oxygen from $CeO_2$ with reducing gases whose reducing power is measured by their partial pressure of oxygen ($pO_2$). The equation for the removal of $O_2$ from $CeO_2$ may be written as follows:

$$CeO_2(s)+XH_2(g)=2CeO_{(2-x)}(s)+H_2O(g) \quad (2)$$

The effect of oxygen ion vacancies created both by reduction and doping have a cumulative effect with respect to improving the ability of $CeO_2$ to remove sulfur from fuel gases. between that of ceric and cerous oxide such as $CEO_{1.92}$. Based on this loss of oxygen and Avogadros number, it can be calculated that there are $2.75\times10^{20}$ oxygen vacancies per gram of $CeO_{1.92}$.

However, for the removal of sulfur from flue gases created by the complete combustion of sulfur containing hydrocarbons, which may contain 3 or 4% oxygen, no reduction oxygen ion vacancies are formed.

SUMMARY OF THE INVENTION

The invention relates to the use of doped $CeO_2$ or other lanthanide oxide to desulfurize both fuel and flue gases because of its superior ability to desulfurize compared to undoped $CeO_2$ or other lanthanide oxide.

All oxygen vacancies in cerium oxide, whether produced by reduction or doping, are equally effective in improving the ability of $CeO_2$ to desulfurize gases. The major difference being that doped vacancies are permanently created in the crystals and reduction vacancies can be reduced in number if the cerium oxide is exposed to a gas whose reducing power is less than the reducing power of the gas that created the vacancies.

A solid solution of oxides containing oxygen ion vacancies is provided. The solid solution has a solvent having at least one lanthanide oxide which crystallizes in the fluorite habit, such as cerium oxide, praseodymium oxide or terbium oxide. The solute of the solution is a second oxide having a valence which differs from the valence of the lanthanide oxide present in the solvent. The second oxide can be an oxide of one of the alkaline earth elements, a lanthanide oxide, or a combination of them. Preferably, the solid solution contains no more than 99.95 mole % of the solvent and between 0.05 and 15 mole % of the solute.

DETAILED DESCRIPTION OF THE PREFERRED EMBODIMENTS

Figure 1:
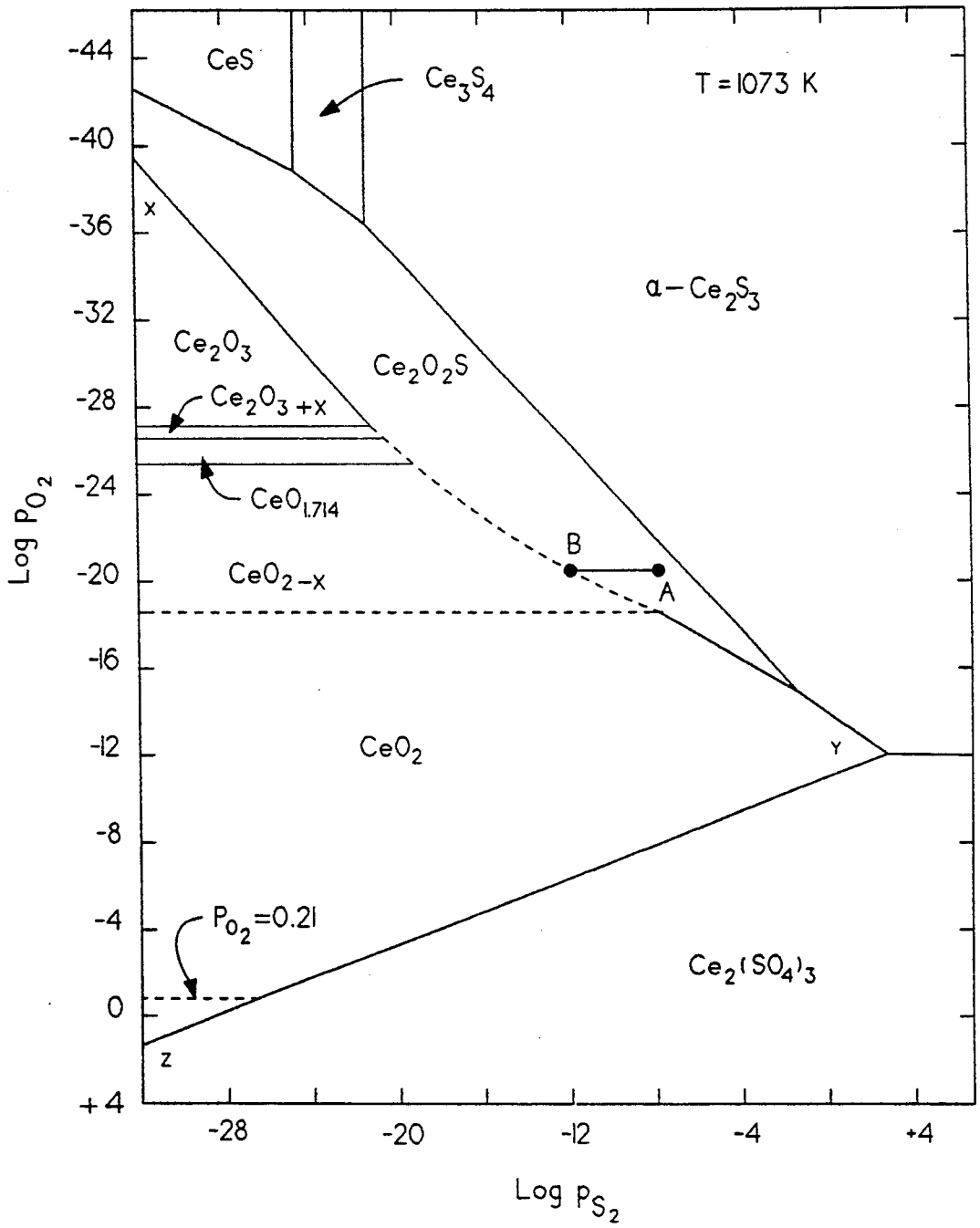
FIG. 1 is a plot of the cerium-oxygen-sulfur phase diagram.
Figure 2:
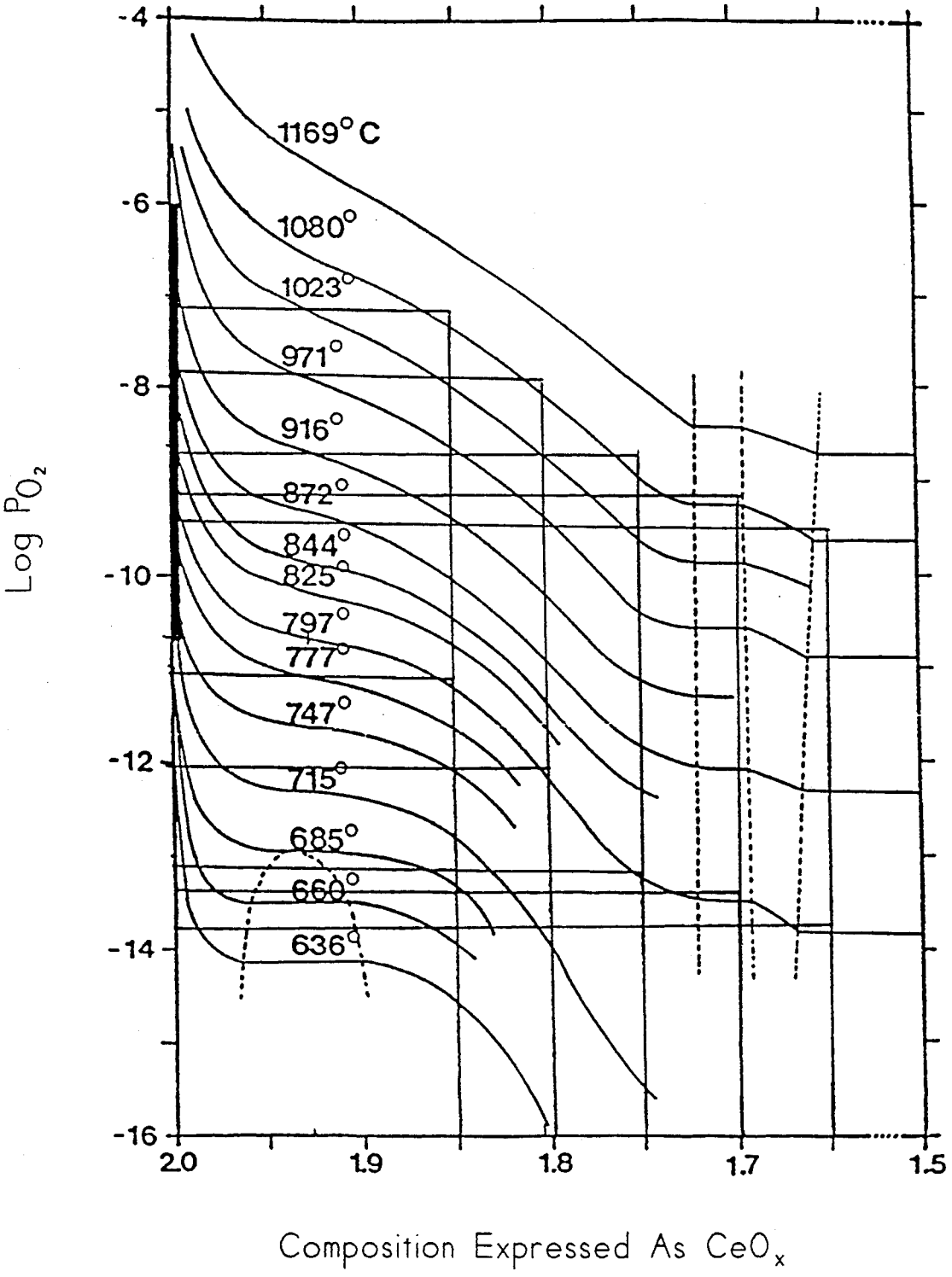
FIG. 2 is a plot of the cerium-oxygen phase diagram as a function of temperature and oxygen partial pressure.

The following examples will demonstrate the effectiveness of oxygen ion vacancies with respect to the movement of sulfur and oxygen anions in and out of cerium oxide.

EXAMPLE I

The effectiveness of doped cerium oxide to increase the rate and extent of removal of oxygen from $CeO_2$ with reducing gases is illustrated as follows:

The samples to be used in this investigation were prepared by dissolving $Ce(NO3)_3.6H_2O$ and the nitrate salts of the dopants in warm distilled water. The material to be utilized in the tests was precipitated by adding ammonia oxalate $[(NH_4)_2C_2O_4.H_2O]$. The precipitate was recovered by filtering the oxalate precipitate in a buchner funnel. The oxalate precipitate was dried for 24 hours and calcined in a muffle furnace at 800° C. for 24 hours. The agglomerates of material were broken up using a mortar and pestle.

The reduction experiments were carried out using a Thermogravimetric Analyzer (TGA) which permits a calculation of the weight loss of the $CeO_2$.

The data is TABLE I can be used to illustrate the effect of doping on rates of reaction and extent of oxygen removal from the doped cerium oxide.

TABLE I

Composition of Non-Stoichiometric Doped Cerium Oxide ($CeO_{(2-x)}$) by Reduction With Hydrogen

| Reduction | | Final Value of (2 − x) with Extent of Doping | | | |
|---|---|---|---|---|---|
| Dopant | Temp °C. | 0 mole % | 5 mole % | 10 mole % | 15 mole % |
| MgO | 800 | | 1.83 | 1.83 | 1.78 |
| BaO | 800 | | 1.85 | 1.84 | 1.88 |
| | 900 | | 1.83 | 1.82 | 1.88 |
| | 1000 | | 1.80 | 1.79 | 1.84 |
| | 1070 | | 1.76 | 1.78 | 1.82 |
| $La_2O_3$ | 800 | | 1.84 | 1.82 | 1.85 |
| | 900 | | 1.80 | 1.79 | 1.84 |
| | 1000 | | 1.76 | 1.75 | 1.83 |
| | 1100 | | 1.72 | 1.69 | 1.80 |
| SrO | 800 | | 1.88 | 1.86 | 1.94 |
| | 900 | | 1.85 | 1.85 | 1.92 |
| | 1000 | | 1.84 | 1.81 | 1.90 |
| | 1100 | | 1.76 | 1.68 | 1.87 |
| None | 800 | 1.99 | | | |
| | 900 | 1.91 | | | |
| | 1000 | 1.87 | | | |
| | 1100 | 1.85 | | | |

These results demonstrate the increased mobility of the oxygen ions remaining in all of the doped $CeO_2$ as compared to the undoped when exposed to reducing gases. Of the dopants investigated, $La_2O_3$ appears to be superior. However, no final conclusion can be made until the results of exposure of MgO doped $CeO_2$ are made at temperatures higher than 800° C. (1372° F.).

The data obtained in the runs in the TGA at 800° C. show that undoped $CeO_2$ is not reduced by hydrogen, the other dopants are very effective in increasing the extent of the reduction. Since the rate of reduction of the undoped $CeO_2$ is zero because there was no reduction, the rates of reduction of the doped $CeO_2$ are greater than the rate of reduction of undoped $CeO_2$.

Of equal importance is the fact that there is no reduction of $CeO_2$ at 800° C. while there is significant reduction of $CeO_2$ at 1000° C. This indicates the importance of doping to increase the reactivity of $CeO_2$ at lower temperatures such as those required for desulfurization of flue gases (350° C. to 550° C.)

The data presented in Table I shows clearly, except when MgO is the dopant, that the extent of reduction is less at 15 mole % of any of the dopants compared to either 5 or 10 mole %.

The number of doped oxygen vacancies created by 10 mole % addition of strontium oxide (SrO) can be computed to be $3.05 \times 10^{20}$ per gram. Since the strontium has a valence of +2 and lanthanum has a valence of +3 the lanthanum will create only half as many doped oxygen vacancies as the strontium.

Another factor determining the extent of reduction of doped cerium oxide is the difference in ionic radii between the material being doped and the dopant. The ionic radii of lanthanum oxide is closer to the ionic radii of cerium oxide that the ionic radii of strontium oxide. As a result, lanthanum oxide may be a more effective dopant for cerium oxide as indicated in TABLE I.

The number of reduction oxygen vacancies created with $CeO_2$ doped with lanthanum oxide when exposed to hydrogen at 800° C. is $7.16\times10^{20}$ oxygen ion vacancies per gram. Since there were no reduction oxygen vacancies created when undoped $CeO_2$ was exposed to the reducing atmosphere, the doped oxygen vacancies made it possible to create $7.16\times10^{20}$ reduction oxygen vacancies. This illustrates the effectiveness of doping on the ability to increase the movement of oxygen in the crystal lattice of $CeO_2$.

EXAMPLE II

The effect of oxygen ion vacancies on the movement of sulfur into cerium oxide can be illustrated as follows:

Granules of $CeO_2$ were prepared for these experiments using the Marcilly technique wherein 68.8 grams of cerium nitrate ($Ce(NO_3)_3.6H_2O$ were mixed with 38.4 grams of citric acid ($HOC(CH_2CO_2H)_2CO_2H$) and 70 milliliters of deionized water. These materials were taken into solution and the solution was placed in a rotating evaporator where moisture was removed until the remaining solution had the consistency of Karo syrup. The solution was placed in a porcelain evaporator dish and placed in a vacuum oven which was operated at 75° C. and 25 inches of vacuum. The balance of the water in the solution was removed in the vacuum oven resulting in the formation of hollow sphere of material approximately 10 inches in diameter. The hollow sphere was moved to a muffle furnace where the temperature was raised to 400° C. At approximately 150° C. there was a release of gases from the hollow sphere accompanied by flames which was probably the ignition of some of the nitrates and part of the citric acid. The material was calcined at 400° C. for three hours. Surface area measurement of material at this stage of processing determined the B.E.T. surface area to be 20 $m^2$/gram. At this stage in the process the material is $CeO_2$, much of it is amorphous. In order to increase the crush strength of the $CeO_2$, the material was sintered in air at 1250° C. The sintering process reduced the B.E.T. surface area to 2 $m^2$/gram and the resulting pellets had a crush strength similar to that of char resulting from mild gasification.

The desulfurization of fuel gases rich in carbon monoxide and hydrogen with cerium oxide was achieved with the $CeO_2$ prepared in the manner describe above. To achieve this desulfurization it was determined that the $CeO_2$ would be subjected to reduction with hydrogen to create oxygen ion vacancies prior to exposure of the cerium oxide to the fuel gases containing sulfur as $H_2S$. The data contained in Table I shows that if $CeO_2$ is exposed to a reducing atmosphere at 1000° C. that oxygen is removed from the $CeO_2$ crystals with the formation of $CEO_{1.87}$ resulting in the formation of reduction oxygen ion vacancies. It is also known that if $CEO_{1.87}$ is exposed to a less reducing atmosphere than hydrogen than the number of oxygen ion vacancies is reduced.

Figure 3:
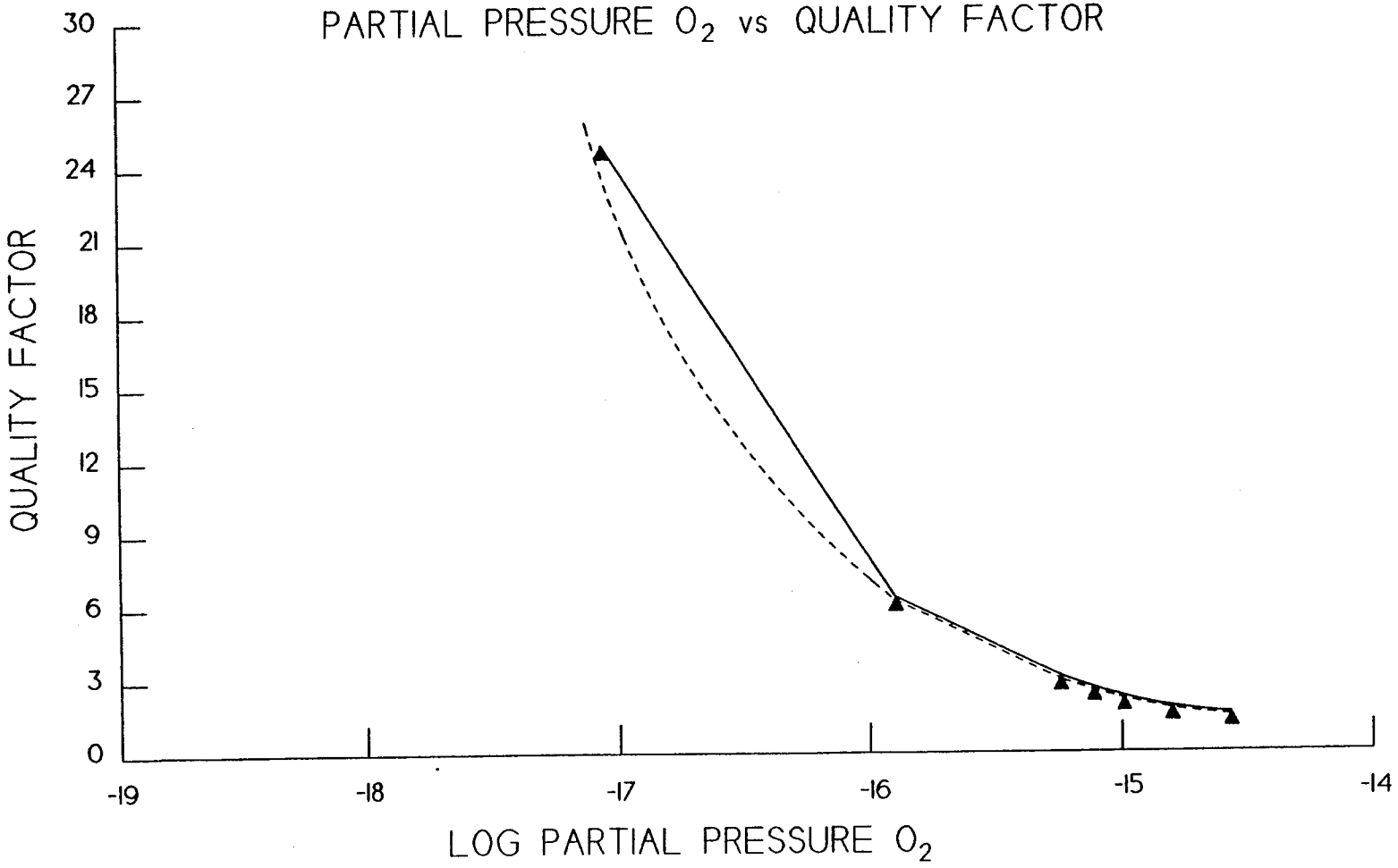
FIG. 3 is a plot of the effect of the oxygen partial pressure on the Quality Factor.
Figure 4:
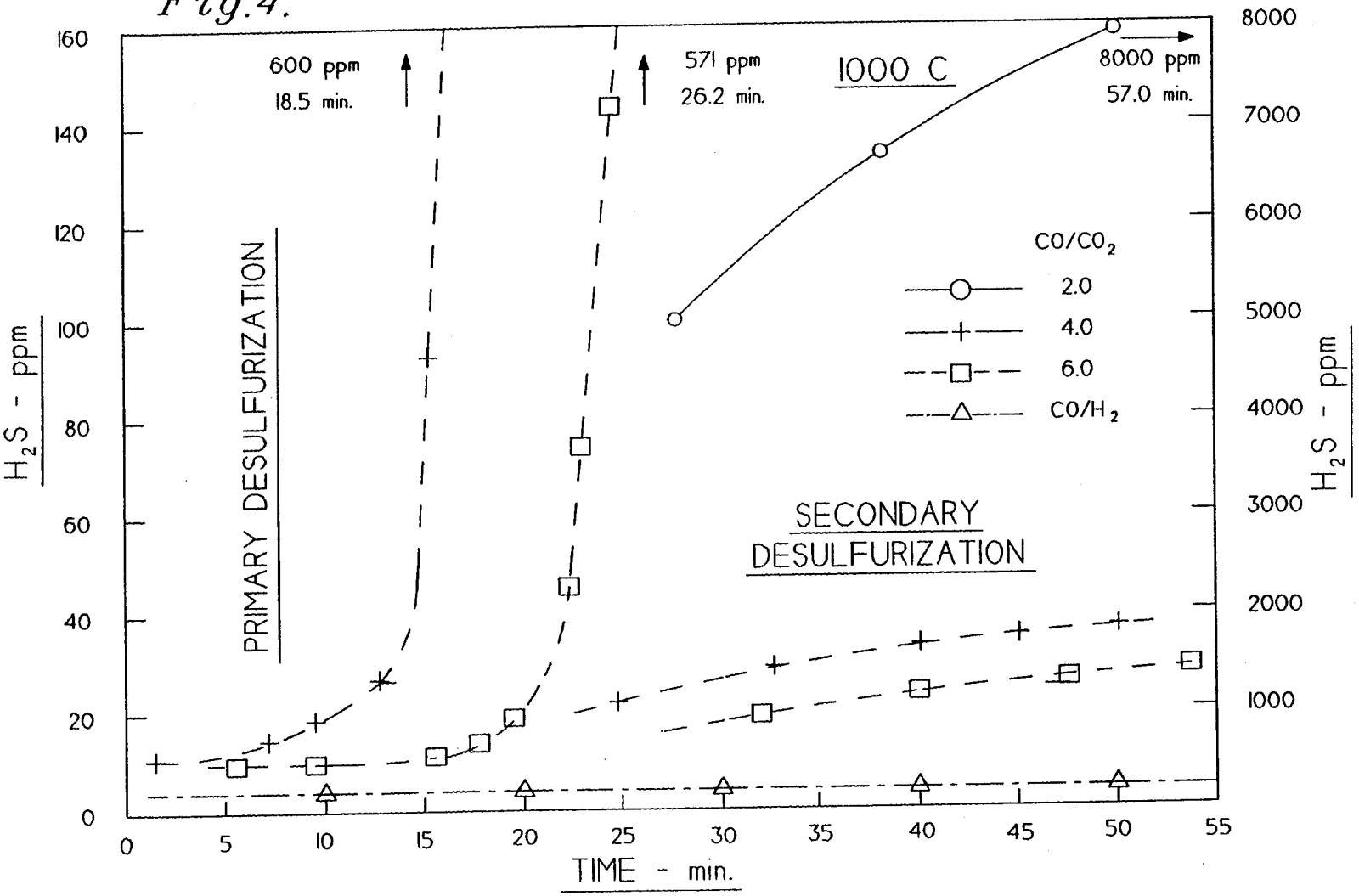
FIG. 4 is a plot of four desulfurization runs having various $CO/CO_2$ ratios.

The reducing power of the gases being desulfurized is directly related at any temperature to the partial pressure of oxygen ($pO_2$) of the gases. As shown in FIG. 3, $pO_2$ is directly related to the ratio [(% CO+ % $H_2$)/(% $CO_2$+ %$H_2O$)] This ratio will hereinafter be called "Quality Factor" or "QF". When the $H_2$ content of the gases being desulfurized is constant, the ratio of CO/-$CO_2$ is also related to $pO_2$, but not as closely related as QF which also considers the amount of $H_2O$ in the gases. The procedure for determining the effect of the number of oxygen vacancies on the amount of sulfur ($H_2S$) in equilibrium with cerium oxide is as follows:

A standard procedure for desulfurization runs to determine the effect of the number of oxygen ion vacancies on the extent of desulfurization that lasted for one hour was to expose a column of $CeO_2$ one centimeter in diameter and six centimeters long (the reactor) to a mixture of 5% hydrogen with the remainder nitrogen for two hours prior to the beginning of the desulfurization run. The results of a series of these desulfurization runs is shown in FIG. 4. For each of these runs made with gases containing 1% $H_2S$ and some $CO_2$ there is a period as long as 20 minutes where the H2S content of the effluent from the reactor is less than 20 ppm. The amount of $CO_2$ in these gases entering the reactor is indicated by the $CO/CO_2$ ratio in the legend on FIG. 4. It is to be noted that there is one gas which contains no $CO_2$. When the gas containing H2S enters the reactor, it encounters the $CeO_{1.87}$ and the reaction that predominates is the removal of the sulfur from the gas by reaction with the cerium oxide. Since the removal of $H_2S$ from the gas is more rapid than the reaction of the oxygen in the gas with the reduction oxygen ion vacancies, the $H_2S$ content of the gas exiting the reactor is at less than the 20 ppm level as indicated in FIG. 4. The desulfurization that occurs first to very low levels will be referred to hereinafter as the "primary desulfurization". However, after the $H_2S$ content of the gas has been almost completely removed, the gases with various $CO/CO_2$ ratios (and various values of $pO_2$) comes in contact with the $CEO_{1.87}$ upstream from the point of entry of the fuel gases into the reactor. The oxygen content in the gases resulting from their $CO_2$ content reduces the number of oxygen ion vacancies. The number of reduction oxygen ion vacancies remaining has not been determined when $CeO_{1.87}$ is exposed to gases with various $CO/CO_2$ ratios, but not all of the reduction oxygen ion vacancies are eliminated. As a result there is further sulfur removal from the gases to various levels depending on the $CO/CO_2$ ratio of the gas being desulfurized. The desulfurization of fuel gases that takes place when the number of reduction oxygen ion vacancies has been reduced has been labeled "secondary desulfurization".

FIG. 4 further shows that as the $CO/CO_2$ ratio of the gases increases, resulting in the retention of a greater number of reduction oxygen ion vacancies, secondary desulfurization results in lower $H_2S$ content fuel gases exiting the reactor. When there is no $CO_2$ in the gases being desulfurized, desulfurization of the gases is to less than 3 ppm of $H_2S$ for one hour.

The data presented above clearly demonstrates that the extent of secondary desulfurization that cerium oxide is capable of attaining is a function of the number of oxygen ion vacancies available in the $CeO_2$ crystals.

EXAMPLE III

The effectiveness of oxygen ion vacancies to increase the utilization of the cerium oxide sorbent may be illustrated as follows:

Further analysis of the data used as the basis for the construction of FIG. 4 make it is possible to calculate the utilization of the sorbent. The utilization of the cerium oxide sorbent as a function of the $CO/CO_2$ ratio is shown in TABLE II:

TABLE II

| $CO/CO_2$ Ratio | % Utilization of the Sorbent |
|---|---|
| 2.0 | 7.94 |
| 4.0 | 14.24 |
| 6.0 | 15.22 |
| No $CO_2$ | 16.14 |

These results clearly demonstrate that the utilization of the sorbent is related to the number of oxygen ion vacancies in the cerium oxide sorbent. All of the information contained in TABLE II is based on runs in the reactor described above that were arbitrarily terminated after one hour. If the runs had been terminated when the $H_2S$ content of the effluent gas from the reactor was equal to the $H_2S$ content of the gas exiting the reactor, the utilization would have been much higher particularly for the gases with the higher $CO/CO_2$ ratios.

EXAMPLE IV

The effectiveness of oxygen ion vacancies to increase the rate of desulfurization of fuel gases may be illustrated as follows:

Analysis of the data contained in FIG. 4 can be used to compute the rate of secondary desulfurization of fuel gases, and that rate can be related to the number of oxygen ion vacancies remaining in the gas being desulfurized. It is recognized that the slope of a curve representing the course of a reaction, such as secondary desulfurization of fuel gases, is related to the rate of secondary desulfurization. Inspection of the curves in FIG. 4 shows that the slope of the secondary desulfurization curves increases as the $CO/CO_2$ ratio of the gases being desulfurized increases. Since the curves are essentially straight lines, it is simple to calculate the slopes of the curves. When the slopes of the curves are multiplied by the rate at which the $H_2S$ is being admitted to the reactor, the result is the rate of secondary desulfurization. The rate of secondary desulfurization for the curves shown in FIG. 4 are shown in TABLE III.

TABLE III

| $CO/CO_2$ Ratio | Rate of Secondary Desulf. |
|---|---|
| 2.0 | 0.412 |
| 4.0 | 0.837 |
| 6.0 | 0.892 |
| No $CO_2$ | 1.00 |

As explained previously, as the $CO/CO_2$ ratio or the QF of the gases being desulfurized increases the number of oxygen ion vacancies remaining in the cerium oxide during secondary desulfurization increases. Therefore the rate of secondary desulfurization increases as the number of oxygen ion vacancies remaining in the cerium oxide increases.

The data presented in Examples II, III, and IV demonstrates that the extent of desulfurization, utilization of the sorbent and rate of desulfurization are closely related to each other and to the number of oxygen ion vacancies remaining in the $CeO_2$.

EXAMPLE V

The superiority of doped $CeO_2$ over undoped $CeO_2$ for the desulfurization of fuel gases containing $H_2S$ produced by the partial combustion of sulfur containing hydrocarbons such as coal may be illustrated as follows:

The concepts of "secondary desulfurization" and "Quality Factor" or QF are explained in EXAMPLE II.

Figure 5:
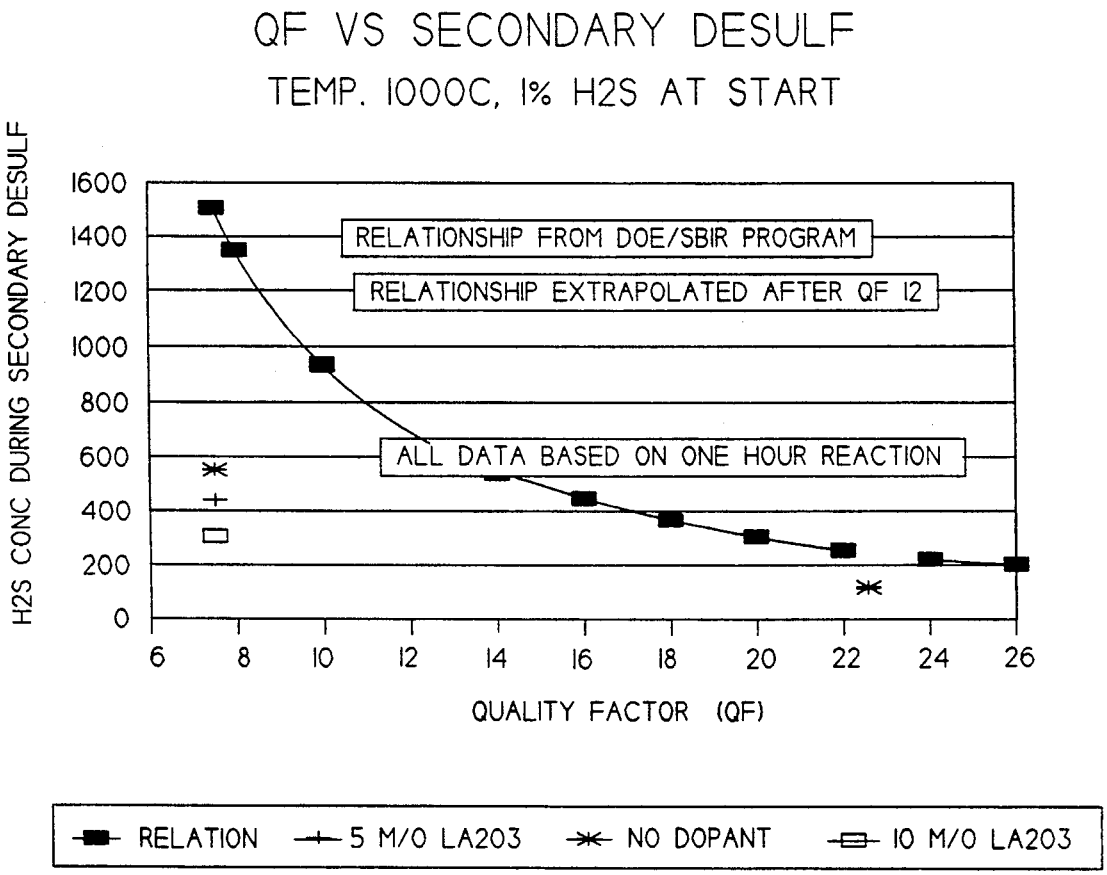
FIG. 5 is a plot of the effect of Quality Factor on $H_2S$ concentrations during secondary desulfurization.

Pellets of doped and undoped $CeO_2$ were prepared as described in Example II using the same raw materials. The pellets were exposed to various QF gases in the microreactor described in that same example or one hour, and the superior ability of doped $CeO_2$ to remove H2S from fuel gases was established. FIG. 5 shows the relationship between QF and the $H_2S$ concentration during secondary desulfurization after the $CeO_2$ has reacted with fuel gases which originally contained 1% H2S. The solid squares show this relationship which was determined previously. The B.E.T. surface area of the undoped $CeO_2$ used was 1.1 $m^2$/gram. The stars indicate the relationship between undoped $CeO_2$ and $H_2S$ concentration during secondary desulfurization after reaction with fuel gas which originally contained 1% $H_2S$ developed during subsequent research. The undoped $CeO_2$ used in this research had a B.E.T. surface area of 2.4 $m^2$/gram. This increase in B.E.T. surface area accounts for the improved ability of the undoped $CeO_2$ to remove $H_2S$ from fuel gases. All of the doped and undoped $CeO_2$ prepared for the most recent research had a B.E.T. surface area of 2.4 to 2.6 $m^2$/gram.

The lower concentration of $H_2S$ in the fuel gases during secondary desulfurization after contact with $CeO_2$ doped with 5 mole % $La_2O_3$ is represented by the crosses. A further improvement in secondary desulfurization is obtained when QF 7.5 fuel gas containing 1% $H_2S$ is exposed to doped $CeO_2$ containing 10 mole % $La_2O_3$. This one point is represented by the open square.

The most recent data from which FIG. 5 is constructed is contained in TABLE IV:

TABLE IV

| Gas QF | BET Surf | Temp | Dopant | Second Desulf |
|---|---|---|---|---|
| 22.5 | 1.1 | 1000° C. | None | 220 ppm |
| 7.5 | 1.1 | 1000° C. | None | 1460 ppm |
| 22.5 | 2.2 | 1000° C. | None | 100 ppm |
| 7.5 | 2.2 | 1000° C. | None | 557 ppm |
| 22.5 | 2.4 | 1000° C. | 5 m/o $La_2O_3$ | 91 ppm |
| 7.5 | 2.4 | 1000° C. | 5 m/o $La_2O_3$ | 437 ppm |
| 7.5 | 2.4 | 1000° C. | 10 m/o $La_2O_3$ | 300 ppm |

Although there are many sulfur containing hydrocarbons, one of the major objectives of this invention is the removal of sulfur, mainly in the form of $SO_2$ from the gases created by the burning of coal in boilers. One of the more common grades of coal used to fire boilers is Illinois #6 which typically contains 3% sulfur. When such a coal is burned with 20% excess air, the typical composition of the resulting gases would be: 3000 ppm $SO_2$, 12% $CO_2$, 4.0% $O_2$, 10.0% $H_2O$ and 73.6% $N_2$ at standard temperature and pressure. In order to meet present Environmental Protection Agency (EPA) standards of less than 1.2 lbs. $SO_2$/MMBtu for new power plants, it can be calculated that there will have to be a minimum of 80% $SO_2$ removal from such gases. An 80% reduction in $SO_2$ would require that the effluent from a power plant burning such coal would have to contain less than 600 ppm $SO_2$.

The equation for the reaction of $CeO_2$ and $SO_2$ is:

$$2/3CeO_2(s)+SO_2(g)+\tfrac{2}{3}O_2(g)=\tfrac{1}{3}Ce_2(SO_4)_3(s) \quad (3)$$

At lower temperatures up to 600° C.-700° C. the reaction proceeds with the formation of $Ce_2(SO_4)_3$. As the temperature increases above that, the rate of dissociation of the sulfate and the rate of formation of the sulfate become nearly equal resulting in little removal of $SO_2$ from flue gases. At temperatures in excess of 925° C. at one atmosphere pressure, the only reaction taking place is the dissociation of the sulfate with the release of $SO_2$ and $O_2$ and the regeneration of the $CE_2(SO_4)_3$ back to $CeO_2$ which is again capable of reacting with the $SO_2$ in the products of combustion of sulfur containing hydrocarbons.

With flue gases of the composition shown directly above there will be no reduction oxygen ion vacancies formed and only the oxygen ion vacancies created by doping the $CeO_2$ will be available. The superior ability of doped $CeO_2$ compared to undoped $CeO_2$ for the removal of $SO_2$ from flue gases is illustrated in the following example:

EXAMPLE VI

Doped and undoped $CeO_2$ were prepared for these experiments according to the procedure described in EXAMPLE I except the procedure was stopped after the pyrolysis step when the B.E.T. surface area was estimated to be 20 $m^2$/gram because the sorbents with a B.E.T. surface area of 2.2 $m^2$/gram were found to be unreactive with the techniques used. A Thermogravimetric Analyzer (TGA) was used to evaluate the ability of these sorbents to react with $SO_2$. The sorbents are placed in the TGA on a pan in the weighing system of the instrument in such a manner that there is a continuous record made of the change in weight of the sorbent during the time the experiment is in progress as a result of the exposure to the gases which passed through the reaction chamber of the TGA. The composition of the gases entering the reaction chamber is controlled by rotometers to produce a gas composition as close to that of the typical analysis of flue gas given above as possible. As reaction (4) proceeds, the sample gains weight and this weight gain is recorded.

Figure 6:
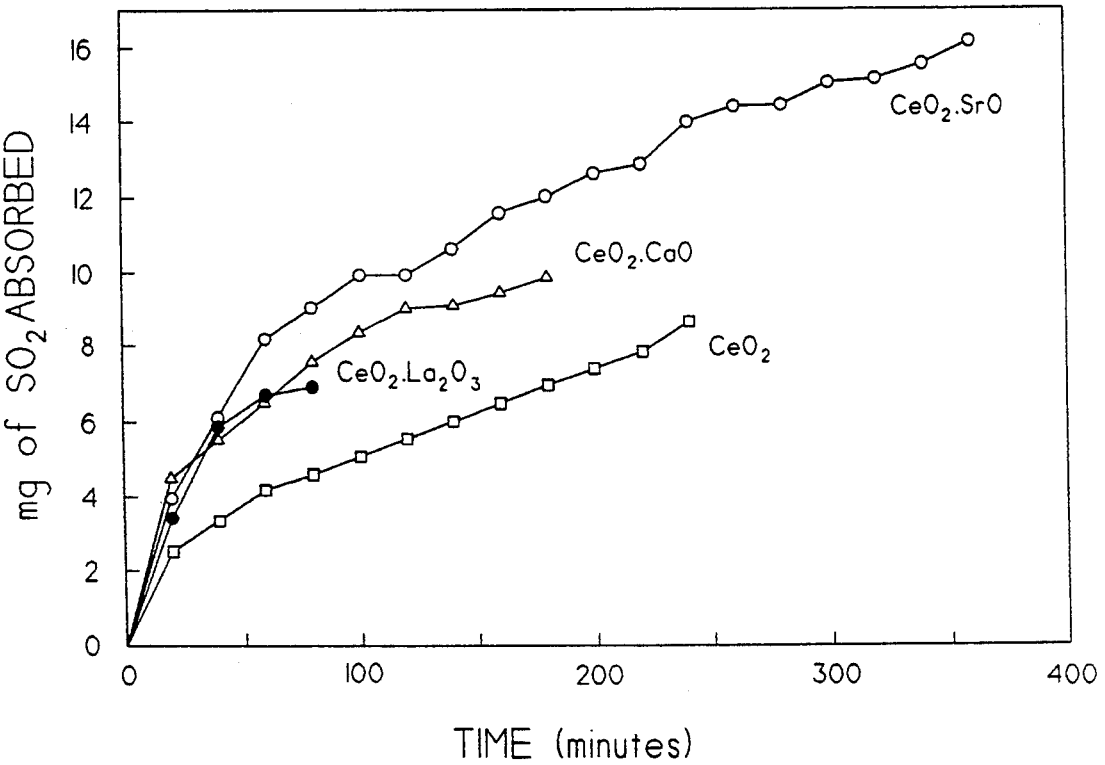
FIG. 6 is a plot of the rate of $SO_2$ uptake by $CeO_2$ doped and undoped sorbents.

The weight gain of a 50 milligrams samples of $CeO_2$ and $CeO_2$ containing 10 mole % (10 m/o) of strontium oxide, lanthanum oxide and calcium oxide after exposure for various times to the synthetic flue gas are shown in FIG. 6. Starting at zero time there is a rapid increase in weight with time. In the case of $CeO_2$ doped with strontium oxide, (SrO) this rapid rise continues for 100 minutes whereas the rapid increase in weight of undoped $CeO_2$ ceases at fifty minutes. After this rapid increase in weight, all sorbents gain weight at a lower rate which is essentially equal for all of the doped and undoped $CeO_2$. Based on the data in the figure, it can be seen that the rate of weight gain (mg of $SO_2$ absorbed per minute) which is directly related to the rate of the reaction of equation (3) is greatest for $CeO_2$ doped with SrO, the rate of weight gain of $CeO_2$ doped with $La_2O_3$ and CaO is less than rate of weight gain of $CeO_2$ doped with SrO, but greater than the rate of weight gain of undoped $CeO_2$.

As can be seen from FIG. 6, increasing the rate of weight gain also increases the utilization of the sorbents.

Rapid rates of reaction are important in the design of systems for the desulfurization of flue gases because the greater the rate of reaction the smaller vessel can be in which the reaction will be conducted thus reducing the capital cost of the system. Also higher utilization of the sorbent will mean that the sorbent will have to be regenerated less frequently which will result in reduction in the operating cost of the system. The effect of lesser amount of dopants on the rate of reaction and utilization of the sorbents when exposed to the synthetic flue gas for one hour has been determined. The results of this part of the investigation are shown in TABLE V below:

TABLE V

CALCULATED RATE OF WEIGHT GAIN AND TOTAL WEIGHT GAIN AFTER EXPOSURE OF DOPED AND UNDOPED SORBENTS TO FLUE GAS AT 550° C.

| | | | % INCREASE | |
|---|---|---|---|---|
| DOPANT | RATE OF WEIGHT GAIN* | TOTAL WEIGHT GAIN | RATE OF WEIGHT GAIN | TOTAL WEIGHT GAIN |
| None | 2.5 | 3.0 mg | — | — |
| None | 2.5 | 3.0 mg | — | — |
| 5 m/o CaO | 4.0 | 4.5 mg | 60.0 | 50.0 |
| 10 m/o CaO | 4.9 | 5.0 mg | 96.0 | 66.7 |
| 5 m/o $La_2O_3$ | 3.0 | 3.0 mg | 20.0 | 0.0 |
| 10 m/o $La_2O_3$ | 4.2 | 5.0 mg | 68.0 | 66.7 |
| 5 m/o SrO | 4.2 | 4.5 mg | 68.0 | 50.0 |
| 10 m/o SrO | 5.6 | 7.5 mg | 124.0 | 150.0 |

*mg/min/gm
Surface area of sorbents predicted to be 30 $m^2$/gm

It is to be noted that in all cases the sorbents containing 5 mole % of the dopant have slower rates of reaction and less utilization than those which contain 10% of the dopant. However, all sorbents with 5 mole % dopant performed better than undoped $CeO_2$ in one way or another.

EXAMPLE VII

The ability of doped $CeO_2$ to achieve greater reduction of $SO_2$ from flue gases than undoped $CeO_2$ may be illustrated as follows.

$CeO_2$ plus 10 mole % SrO and $CeO_2$ only were deposited onto an alumina substrate with techniques known to those skilled in the art.

Figure 7:
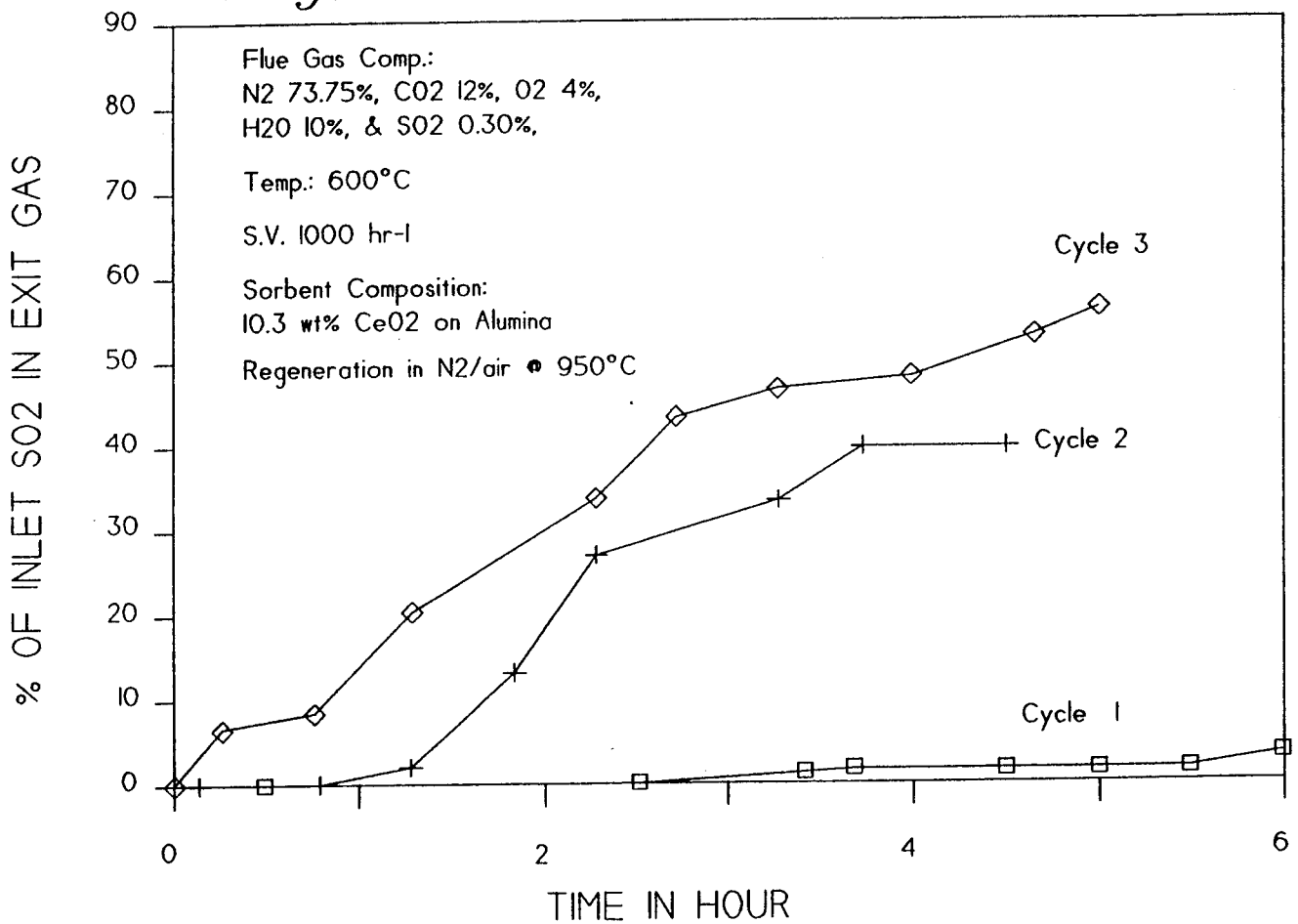
FIG. 7 is a plot of three successive desulfurization runs using regenerated 10.3 wt % $CEO_2$ sorbent on alumina.

The results obtained when the undoped $CeO_2$ on the alumina support was exposed in a quartz tube reactor to flue gases whose composition was 73.7% $N_2$, 12% $CO_2$, 4% $O_2$, 10% $H_2O$ and 0.3% $SO_2$, are presented graphically in FIG. 7. In the first cycle there was almost complete removal of the $SO_2$ for six hours. Regeneration of the sulfated sorbent was conducted at 950° C. which reduced the surface area of the substrate so that the extent of $SO_2$ reduction in the second cycle of sulfidation and regeneration was much lower than in the first. There was less $SO_2$ removed during the third cycle than during the second cycle.

Figure 8:
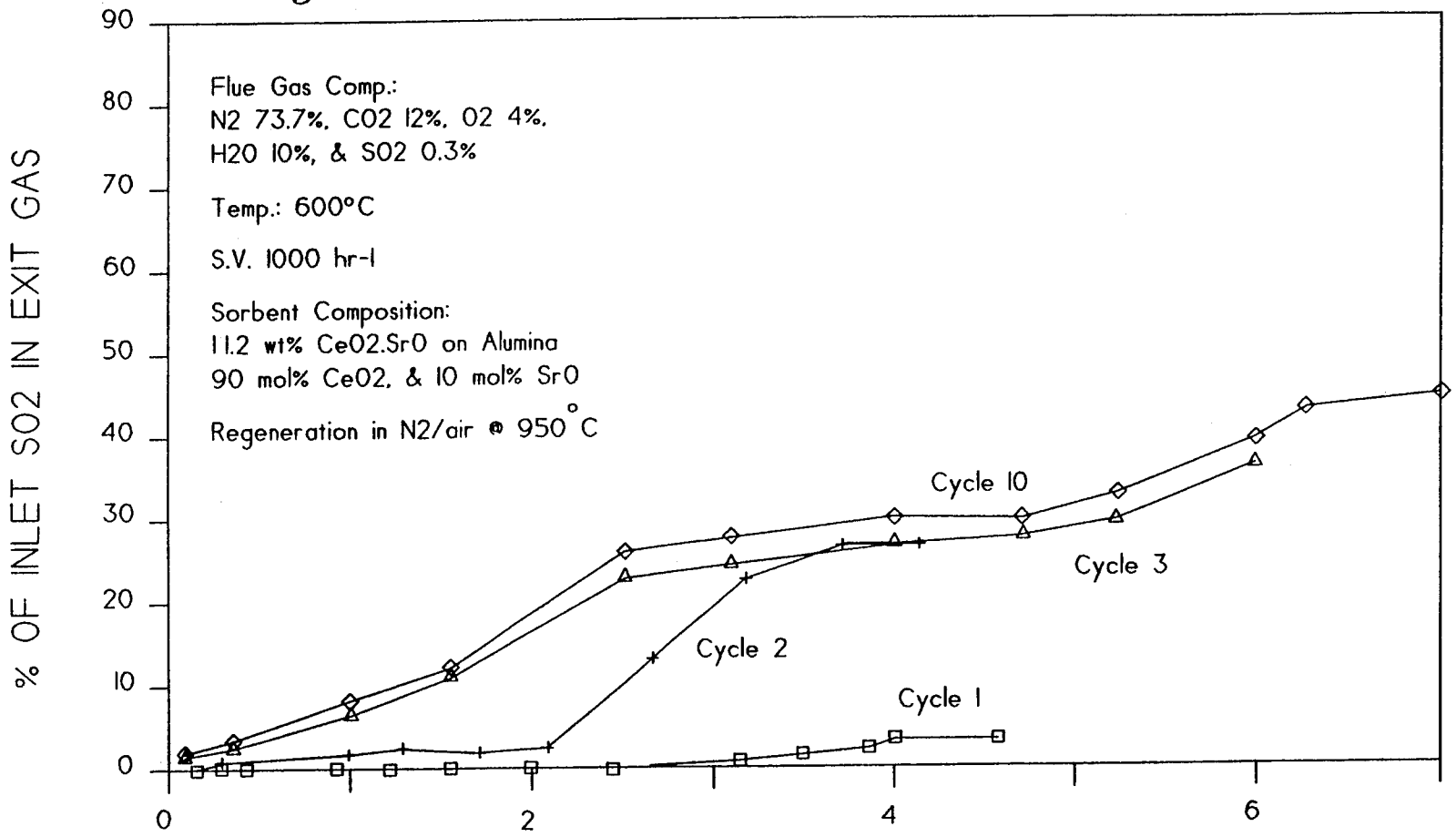
FIG. 8 is a plot of the first, second, third, and tenth successive desulfurization run using regenerated 11.2 wt % $CeO_2.SrO$ sorbent on aluminum having a $CeO_2$ to SrO mole ratio of 9:1.

The $CeO_2$ doped with 10 mole % SrO on the alumina was exposed to flue gases of the same analysis at the same temperature in the quartz reactor as the undoped $CeO_2$ and the results thereof are presented graphically in FIG. 8. The $SO_2$ content of the gases effluent from the reactor during the first cycle of sulfidation was the same as for the doped $CeO_2$ as the undoped $CeO_2$. Due to the reduction in surface area of the doped $CeO_2$ on the alumina because of the high temperature of regeneration, the extent of desulfurization was less than subsequent cycles. After four hours of exposure to the flue gases, the $SO_2$ content of the flue gases exiting the reactor after third cycle was 25% of that of the inlet gas. In contrast, with the undoped $CeO_2$ there was 45% of the inlet $SO_2$ in the gases effluent from the reactor after the third cycle. This data illustrates the superiority of the doped $CeO_2$ compared to undoped $CeO_2$ to lower the $SO_2$ content of flue gases.

Various embodiments and modifications of this invention have been described in the foregoing description and examples, and further modifications will be apparent to those skilled in the art. Such modifications are included within the scope of the invention as defined by the following claims.

We claim:

1. A solid solution of oxides containing oxygen ion vacancies for the desulfurization of sulfur containing gases consisting essentially of:

(a) no greater than 99.95 mole percent of a solvent having at least one lanthanide oxide which crystallizes in the fluorite habit; and (b) between 0.05 and about 15 mole percent of a solute having at least one second oxide capable of forming a solid solution with said at least one solvent lanthanide oxide, wherein the valence of said second oxide differs from the valence of said at least one lanthanide oxide, said at least one solvent lanthanide oxide being selected from one of the group of lanthanide oxides which do not crystallize in the fluorite habit and the group of oxides of the alkaline earth elements.

2. The solid solution of claim 1 wherein said at least one solvent lanthanide oxide which crystallizes in the fluorite habit is selected from the group consisting of cerium oxide, praseodymium oxide and terbium oxide.

3. The solid solution of claim 1 wherein said solute second oxide is an oxide of an alkaline earth element, said alkaline earth element being altervalent to said solvent lanthanide oxide.

4. The solid solution of claim 3 wherein said alkaline earth element is selected from the group consisting of magnesium, calcium, strontium, and barium.

5. The solid solution of claim 1 wherein said solute second oxide is lanthanum oxide.

6. The solid solution of claim 1 wherein said solute second oxide comprises a combination of at least two oxides selected from the group of lanthanide oxides which do not crystallize in the fluorite habit, said group of lanthanide oxides being altervalent to said solvent lanthanide oxide.

7. The solid solution of claim 1 wherein said solute second oxide comprises a combination of at least two oxides of alkaline earth elements.

8. The solid solution of claim 1 wherein said solution is applied to a substrate.

9. The solid solution of claim 8 wherein said substrate is formed from alumina.

* * * * *